United States Patent [19]

Zingel

[11] Patent Number: 4,464,893

[45] Date of Patent: Aug. 14, 1984

[54] SPINNING MACHINE, IN PARTICULAR RING SPINNING MACHINE

[75] Inventor: Heinz Zingel, Beringen, Switzerland

[73] Assignee: Rieter Machine Works Ltd., Winterthur, Switzerland

[21] Appl. No.: 387,833

[22] PCT Filed: Oct. 7, 1981

[86] PCT No.: PCT/EP81/00158

§ 371 Date: Jun. 2, 1982

§ 102(e) Date: Jun. 2, 1982

[87] PCT Pub. No.: WO82/01385

PCT Pub. Date: Apr. 29, 1982

[30] Foreign Application Priority Data

Oct. 14, 1980 [CH] Switzerland ..... 7647/80

[51] Int. Cl.[3] ..... D01H 9/10; D01H 9/18

[52] U.S. Cl. ..... 57/267; 57/266; 57/270; 242/35.5 A

[58] Field of Search ..... 57/90, 266, 267, 268, 57/270, 274, 275, 276, 281; 242/35.5 A, 35.5 R, 46

[56] References Cited

U.S. PATENT DOCUMENTS 3,123,967 3/1964 Ingham ..... 57/275 X 4,023,339 5/1977 Laderach et al. ..... 57/281 X

*Primary Examiner*—Donald Watkins

*Attorney, Agent, or Firm*—Werner W. Kleeman

[57] ABSTRACT

On the main frame (1) of the ring spinning machine a box-shaped frame (11) is supported, which is used for exchangeably and loosely taking up storage devices (14), which can be lined up in a row. The storage devices (14) on their lower side are provided with a plurality of suspension devices (16) for taking up the roving bobbins (10). The frame (11) also is used as a rail arrangement for a transporting carriage (15), which can, using suitable elevator devices (17,18), and along its movement from one end of the machine to the other, take up at least one plate-shaped storage device (14) with empty roving bobbins (10), and can deposit at this location a plate-shaped storage device (14) with full roving bobbins (10).

These measures permit complete automation of the exchange of roving bobbins on the machine.

11 Claims, 4 Drawing Figures

SPINNING MACHINE, IN PARTICULAR RING SPINNING MACHINE

BACKGROUND OF THE INVENTION

The present invention concerns a spinning machine, in particular a ring spinning machine, with a plurality of spinning positions arranged in a row, to which spinning positions at least one roving bobbin support each is coordinated.

It is generally known, that on spinning machines, and on ring spinning machines in particular, the exchange of roving bobbins still is effected manually. For this purpose, the full roving bobbin packages are deposited in containers in close vicinity of the machine concerned and than they are exchanged individually against empty bobbin tubes. For this purpose a number of roving bobbin support members, corresponding to the number of spinning positions, designed as self-fixing suspension devices, onto which the roving bobbins are pushed from below, are arranged on an upper horizontal frame of the machine. Considering on one hand the high weight of the roving bobbins, which today averages about 2.5 kg, but which, in the future, may reach 5 kg, and on the other hand also the great number of spinning positions of up to about 400 spinning positions or more per machine side, as used today it becomes clear that the operating personnel is subject to very heavy work loads, not to mention a certain monotony of this type of work.

SUMMARY OF THE INVENTION

Therefore, with the foregoing in mind, it is the object of the present invention to automate the exchange of the roving bobbins. For this purpose, mechanisation of the hitherto manually effected loading process, using linear moving devices, could be imagined, which, however, would result in unbearable expenses. Thus it is a further object of the present invention, to automate the exchange of the roving bobbins using a technically elegant and economically feasible concept.

These objects are achieved according to the invention in that a number of roving bobbin support members each are grouped for neighbouring spinning positions on a mobile storage device, in which arrangement the storage devices are movable individually or in pairs along the length of the machine using a transporting device, and at predetermined places can be lifted to, and lowered from respectively, the transporting device using elevator devices.

These measures now permit direct loading of the mobile storage devices at the roving producing machine automatically with full roving bobbin packages, and to move these loaded storage devices along the ring spinning machine, and to exchange them against corresponding storage devices with empty roving bobbin tubes automatically at practically any desired place along the machine.

A suitable embodiment of the present invention then consists in designing the mobile storage devices as plates, which can be exchangeably set side by side, in at least one row, in a frame, in which arrangement it proves advantageous, if the plate-shaped storage devices on their underside are provided with a plurality of self-locking suspension devices for taking up the roving bobbins.

Furthermore it proves advantageous, if the frame is designed as a rail arrangement for the transporting device, and extends above the machine, in which arrangement advantageously the transporting device is a transporting sledge or a transporting carriage, provided with at least one lifting device for taking up at least one storage device.

Furthermore it proves advantageous, if each lifting device comprises a mounting plate for its temporary mechanical and/or electromagnetic connection with a plate-shaped storage device, in which arrangement the transporting carriage furthermore supports a control and drive unit, which on one hand activates the lifting devices, and on the other hand acts onto a toothed rack rail via a motor pinion cog wheel gear.

A further embodiment of the arrangement consists in that the frame forming the rail arrangement for the transporting device extends over the face sides of the machine into transfer stations for the storage devices, holding the full and the empty bobbins, respectively, in which arrangement each transfer station comprises a transfer lifting device and a take-up frame for the storage devices.

Preferentially, the whole roving bobbin exchange is controlled by a programmable processor arrangement.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is to be understood that only enough of the construction of the spinning machine has been shown as needed for those skilled in the art to readily understand the underlying principles and and concepts of the present development, while simplifying the showing of the drawings.

Figure 1:
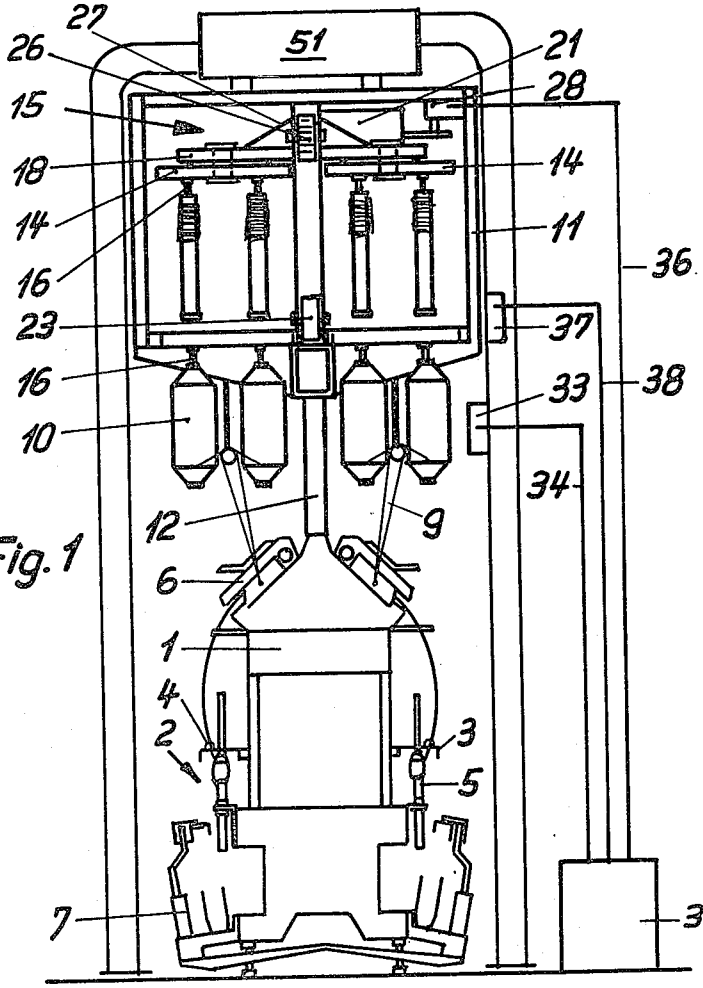
FIG. 1 a schematic end view of a double-sided ring spinning machine with the inventive means for an automatic exchange of the roving bobbins, FIG. 2 a schematic side view of the machine according FIG. 1, FIG. 3 a detail of the machine according to FIG. 2, shown at an enlarged scale, and in FIG. 4 a top view of the arrangement according to FIG. 3.
Figure 2:
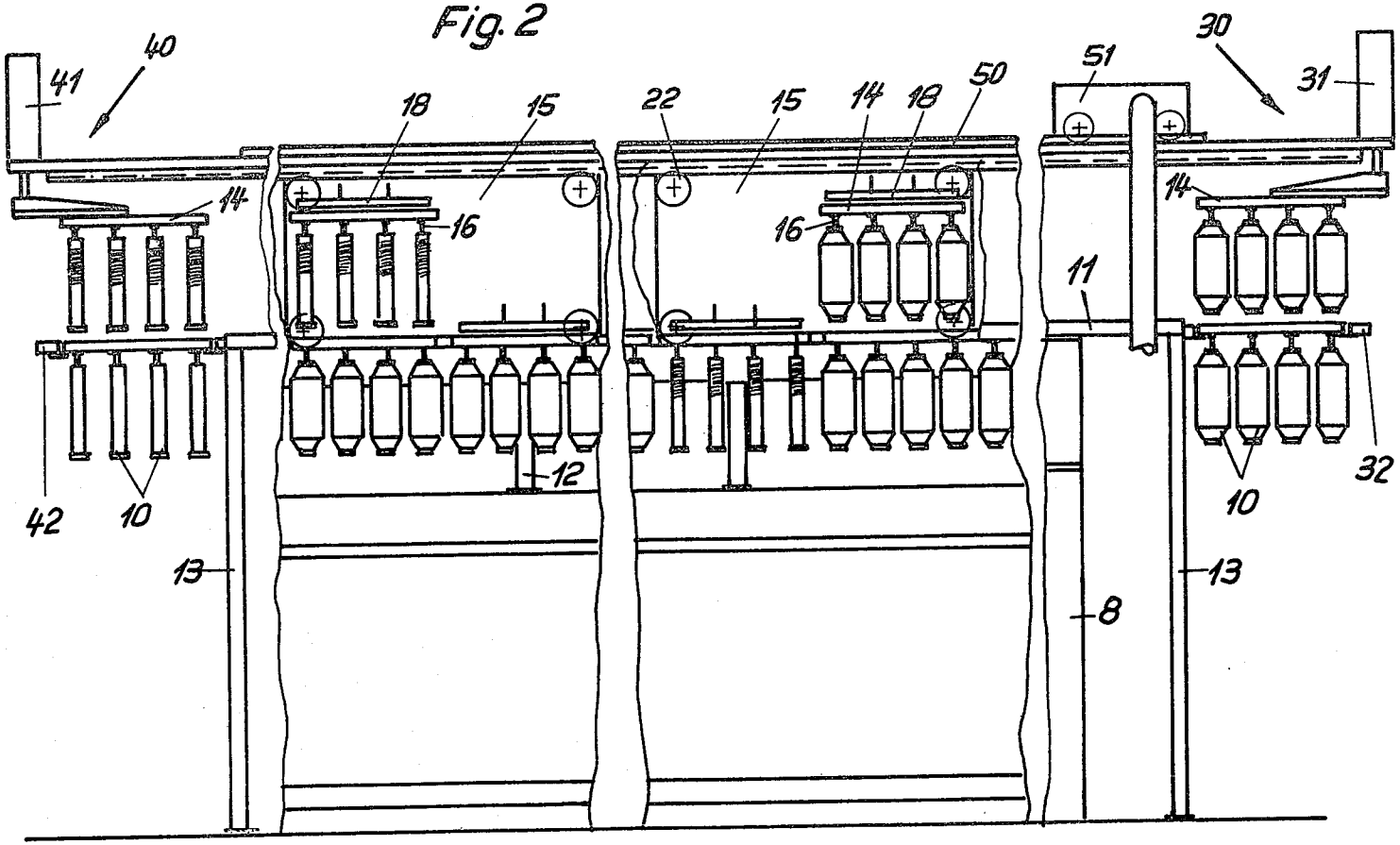

The double-sided ring spinning frame shown in FIGS. 1 and 2 comprises, in conventional design, a main frame 1 with a plurality of spinning units 2 arranged at both longitudinal sides of the machine, which, as shown clearly in FIG. 1, cooperate each with an anti-balloon ring, and a ring holder 3, and with a traveller 4, for winding a yarn 9 each onto a spinning bobbin tube 5. This yarn 9 is taken from a roving bobbin 10, of which roving bobbins a plurality is suspended in two rows to both sides of the machine above the main frame 1, and are processed in a drafting arrangement 6. The spinning bobbin tubes 5 are automatically exchanged using a so-called doffer arrangement 7, which is mounted onto the main frame 1. At least at one face side of the machine furthermore a control and drive cabinet 8 is arranged (FIG. 2).

This design of a ring spinning machine, as described thus far, is generally known, and a more detailed description can be dispensed with, as the machine components of the arrangement described above are not relevant for the present invention.

For the inventive automatic roving bobbin exchange arrangement a box-shaped frame 11 extends above, and over the full length of, the main frame 1 and somewhat beyond, the frame 11 being supported partially by intermediate support elements 12 on the main frame 1 and partially by end support elements 13 on the floor.

The lower frame beams in this arrangement support the plates 14, which are placed loosely and interchangeably at both sides along the machine, and which form mobile storage devices, which in a manner to be described in the following can be deposited, and taken off again respectively, substantially one by one consecutively.

Figure 4:
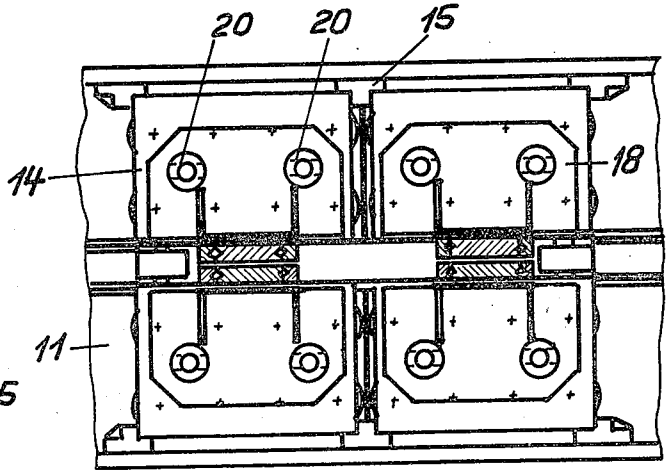

The storage devices 14, shown here as plate-shaped members, are provided, on their underside, with a plurality of self-locking suspension devices 16 of known design, onto which the roving bobbins 10 are placed in known manner. Each of the plate-shaped storage devices 14 in this arrangement supports, in two rows one behind the other, four suspension devices 16 each for taking up eight roving bobbins 10 (FIG. 4). This arrangement of course, can be varied as desired.

For taking up the plate-shaped storage devices 14 for an automatic exchange of the roving bobbins, and for depositing them again—loaded with full roving bobbins 10—the box-shaped frame 11 also is used as a rail arrangement for a transporting sledge or carriage 15 with lifting devices, to be described in more detail later, using which transporting carriage 15 at least one plate-shaped storage device 14 with empty roving bobbin tubes can be taken up along the passage of the transporting carriage 15 from one machine end to the other, and at this place a plate-shaped storage device 14 with full roving bobbins 10 can be deposited, in such a manner that at the spinning positions concerned the spinning process can be resumed in the usual manner.

Figure 3:
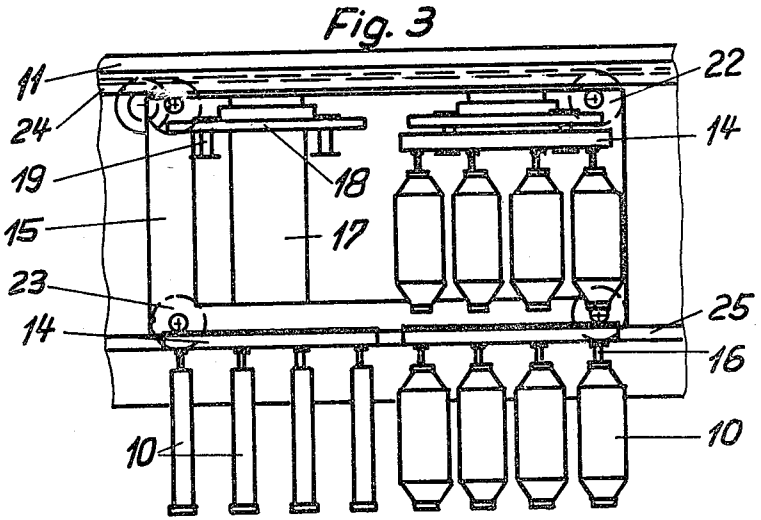

The transporting carriage 15, which in the arrangement shown is suitable for effecting an exchange of a storage device on both machine sides simultaneously or after a time lag, in particular is provided, according to FIGS. 3 and 4, with means for taking up two storage devices 14 each per machine side. These means comprise, for each storage device, a vertically movable elevator 17, e.g. in the form of a pneumatic cylinder with telescoping means, an electric linear motor, or a similar device (not shown in more detail), using which elevator 17 an elevator platform 18 is moved up and down. This elevator plate 18, as shown clearly in FIGS. 3 and 4, contacts with its surface the upper surface of the storage device 14 concerned, the two members being connectable in such a manner, that the storage device 14 can be lifted or lowered, as the elevator platform 18 is lifted or lowered.

The connection between the elevator platform 18 and the storage device 14 can be effected in many manners, be it using holding magnet means, or as shown here, using a twist-locking socket type arrangement, with gripper pins 19 provided on the lower side of the elevator plate 18, which can be rotated and lockingly can be inserted into corresponding openings 20 provided in the storage device 14.

The transporting carriage 15 furthermore is supported, using rolls 22 and 23, on an upper and on a lower rail 24 and 25 respectively, extending along the centerline of the box-shaped frame 11. Also this guide roll arrangement for the transporting carriage is shown as an example merely, various different solutions being feasible also.

The controlled to and fro reciprocating movement of the transporting carriage 15 in the box-shaped frame 11 is activated by a control and drive unit 21, which is mounted on the upperside of the transporting carriage 15. This control and drive unit 21 acts via a motor pinion cog wheel gear 26 onto a toothed rack rail 27. This control and drive unit 21 receives its signals for its forward and backward movement, as well as for the activation of its elevator devices 17,18, and of the corresponding locking means 19,20 respectively, via current supply rails 28.

As visible from FIG. 2 the ring spinning machine described above at its ends extends into a transfer station 30 for storage devices with full roving bobbins, and into a transfer station 40 respectively, for storage devices with empty roving bobbins. These transfer stations are connected in a suitable manner, not shown in more detail, with e.g. the roving-producing machine, for transporting the empty roving bobbins, and for supplying the storage devices with full roving bobbins. Each transfer station is equipped, for this purpose, with an elevator device 31, and 41 respectively, which in a suitable manner takes the storage devices 14 into a take-up frame 32, from where the storage devices 14 can be taken over by the transporting carriage 15, and which, respectively, lifts the storage devices 14 off a take-up frame 42, into which the storage devices where placed by the transporting carriage 15.

In FIGS. 1 and 2 it is shown furthermore, that on the box-shaped frame 11 also a pair of rails 50 is supported, on which the pneumatic machine blower fan 51 is movably arranged.

In operation of the ring spinning machine described above, now suitable capacitive or opto-electric contractor means 33 (FIG. 1) control the state of the roving bobbins 10, suitably one each per section determined by the storage devices 14. An "empty" signal transmitted via the circuit 34 to a processor arrangement 35 then via a coaxial circuit 36 connected to the current supply rail 28 activates the transporting carriage 15, until it comes to a standstill with its free elevator device 17,18 above the storage device 14 with the empty roving bobbins 10. This position is visualized at the right hand side in FIG. 2.

The individual stopping positions for the transporting carriage 15 can be determined by suitable signal transmitters 37 (FIG. 1) and can be transmitted via a corresponding circuit 38 to the processor arrangement 35, which in turn then transmits the control signals via the coaxial circuit 36 to the control and drive unit 21 of the transporting carriage 15.

By means of suitably programming the processor arrangement 35, and by means of corresponding signals transmitted via the coaxial circuit 36 to the control and drive unit 21 of the transporting carriage 15, the latter now first can take up the storage device 14 with the empty roving bobbins 10, and then can move over to the left hand side over one section length, where, according to FIG. 2 now the lowering of the storage device 14, with the full roving bobbins 10 carried on the transporting carriage 15, into the cleared frame section can be effected. Thereupon the transporting carriage 15, now carrying the storage devices with the empty roving bobbins, moves to the transfer station 40, shown at the left hand side of the drawing, where the storage devices are deposited in the take-up frame 42, from where they are transferred in the manner described above by the corresponding transfer elevator device 41. The transporting carriage 15 then moves back empty to the transfer station 30, shown at the right hand side in the drawing, where it takes up again new storage devices with full roving bobbins from the take-up frame 32.

From the description above, it is clearly recognisable, that in this manner a fully automatic roving bobbin change is effected, in which the measures taken permit an elegant, easy to control and clear concept. In particular, the above-mentioned measures permit retro-fitting of the apparatus to existing machines at any time. Of course, a great number of application possibilities can be imagined within the scope of the present invention. On each machine side, e.g. a separate transporting carriage can move to and fro, or a plurality of transporting carriages can be used, of which e.g. the ones only carry storage devices with empty roving bobbins, and the other ones only storage devices with full roving bobbins.

While there are shown and described present preferred embodiments of the invention, it is to be distinctly understood that the invention is not limited thereto, but may be otherwise variously embodied and practiced within the scope of the following claims. Accordingly,

What I claim is:

1. A spinning machine, in particular a ring spinning machine, comprising:

a multitude of spinning locations arranged in a row;

a multitude of roving bobbin support devices;

each said roving bobbin support device being operatively associated with one of said spinning locations and serving to hold one roving bobbin;

a predetermined number of mobile storage devices;

said roving bobbin support devices forming groups of roving bobbin support devices;

each said group of roving bobbin support devices being arranged at a related one of said mobile storage devices and being operatively associated with adjacent ones of said spinning locations;

a predetermined number of transport devices;

drive means for operating said transport devices;

said transport devices being drivable by said drive means to travel along said spinning machine;

each said transport device comprising at least one elevator device; and at least one of said mobile storage devices being operatively associated with said elevator devices of said transport devices such that at least one of said mobile storage devices can be gripped by individual ones of said elevator devices and thereby can be displaced between an inoperative position above said spinning machine and an operative position in said spinning machine in which operative position the roving bobbins held by said group of roving bobbin support devices at said at least one mobile storage device serve as feed bobbins in said spinning machine.

2. The spinning machine as defined in claim 1, further including:

a frame; and said mobile storage devices comprise plates which are exchangeably arranged in at least one row on said frame.

3. The spinning machine as defined in claim 1, wherein:

each said mobile storage device defines a bottom side;

said group of roving bobbin support devices arranged at said related one of said storage devices being disposed at said bottom side thereof; and each said group of roving bobbin support devices comprising self-locking suspension devices taking up the related roving bobbins which are pushed thereon.

4. The spinning machine as defined in claim 2, wherein:

said frame defines a rail arrangement extending above the spinning machine; and said transport devices being driven by said drive means along said rail arrangement.

5. The spinning machine as defined in claim 1, wherein:

each said transport device comprises a transport carriage.

6. The spinning machine as defined in claim 2, wherein:

each said elevator device comprises a mounting plate; and means for connecting said mounting plate to individual ones of said plates forming said mobile storage devices.

7. The spinning machine as defined in claim 6, wherein:

said connecting means comprises mechanical means for temporarily connecting said mounting plate to individual ones of said plates forming said mobile storage devices.

8. The spinning machine as defined in claim 4, wherein:

said drive means comprise a predetermined number of control and drive units;

each said control and drive unit being disposed on a related one of said transport devices;

each said control and drive unit on said related transport device being operatively connected to said at least one elevator device of said transport device;

said rail arrangement including a toothed rack; and each said control and drive unit further including motor-driven gear means drivingly connected to said toothed rack.

9. The spinning machine as defined in claim 4, wherein:

said frame defines end faces;

transfer stations arranged at said end faces;

said rail arrangement extending beyond said end faces into said transfer stations; and one of said transfer stations being operable for the transfer of mobile storage devices holding empty roving bobbins at the related group of roving bobbin support devices and the other one of said transfer stations being operable for the transfer of mobile storage devices holding full roving bobbins at the related group of roving bobbin support devices.

10. The spinning machine as defined in claim 9, wherein:

each said transfer station comprises a transfer elevator device and a take-up frame which are operatively associated with individual ones of said mobile storage devices.

11. The spinning machine as defined in claim 1, further including:

a microprocessor for controlling the transport of said transport devices and the displacement of said mobile storage devices between said inoperative and said operative positions thereof.

* * * * *